United States Patent [19]

Evertz

[11] 4,404,232

[45] Sep. 13, 1983

[54] METHOD OF DEPOSITING METAL COATING LAYERS CONTAINING PARTICLES ON THE WALLS OF CHILL MOULDS

[76] Inventor: Egon Evertz, Vorlander Strasse 23, 5650 Solingen, Fed. Rep. of Germany

[21] Appl. No.: 309,170

[22] Filed: Oct. 6, 1981

[30] Foreign Application Priority Data

Oct. 10, 1980 [DE] Fed. Rep. of Germany ..... 3038289

[51] Int. Cl.[3] ..... C23C 3/02

[52] U.S. Cl. ..... 427/8; 204/1 T; 204/26; 204/49; 427/135; 427/304; 427/443.1

[58] Field of Search ..... 427/135, 304, 443.1 C, 427/8; 204/26, 49, 1 T

[56] References Cited

U.S. PATENT DOCUMENTS 3,753,667 8/1973 Metzger ..... 427/443.1 C
4,037,646 7/1977 Hara et al. ..... 427/135

FOREIGN PATENT DOCUMENTS 56-108870 8/1981 Japan ..... 427/443.1 C

OTHER PUBLICATIONS

Hubbell, "Chemically Deposited Composites–A New Generation of Electroless Coatings", Plating and Surface Finishing, Dec. 1978, pp. 58–62.

*Primary Examiner*—John D. Smith
*Attorney, Agent, or Firm*—Holman & Stern

[57] ABSTRACT

A method of depositing a metal coating on the wall of a chill mould for use in continuous casting wherein the mould is placed in a deposition bath such that an internal wall thereof to be coated is oriented generally upright, the deposition bath being composed of a solution containing at least one nickel salt and a suspension of particles of a hard metal having a critical deposition temperature range defined by upper and lower limit temperatures. A metallic layer containing nickel is deposited on the mould wall either by electrolytic or by electroless techniques, and during such deposition the mould wall is maintained at a temperature in the vicinity of one of the upper and lower limit temperatures while the solution is maintained at a temperature in the vicinity of the other of the limit temperatures, the temperature difference between the mould wall and the solution being within the aforesaid critical deposition temperature range. During deposition, the solution is maintained in a turbulent state and is circulated at a speed in excess of the sedimentation speed of the hard material particles suspended therein and also in the opposite direction to rising and falling currents along the mould wall. Where the mould wall is made of copper and the deposition is performed by an electroless method, the mould wall can be treated by applying to it a stream of free-falling iron balls which are recirculated.

7 Claims, No Drawings

METHOD OF DEPOSITING METAL COATING LAYERS CONTAINING PARTICLES ON THE WALLS OF CHILL MOULDS

BACKGROUND OF THE INVENTION

1. Field of the Invention

The invention relates to a method of depositing metal coating layers on the walls of chill moulds for continuous castings, particularly of slabs, from electrolyte baths with a critical deposition temperature range which is predetermined by an upper and a lower limit temperature.

2. Description of the Prior Art

The mould walls of continuous casting moulds of the type to which the present invention relates are normally assembled to the required dimensions with the aid of housing- or frame plates which cover the cooling passages provided on the backside of the mould walls. In order to preserve wear resistance of the interior mould wall relative to the movement of starter castings inside the moulds at the start of a continuous casting operation and subsequently to the molten and solid steel, the interior mould walls are often galvanically plated, mostly by hard- or electro-chromium plating. As a general rule, the lower and upper temperature limits between which deposition must take place are predetermined for the electrolyte solutions which are used. The thermal conductivity of the mould walls, which consist of copper, is not significantly impaired by these coatings so that mould performance is essentially preserved. However, the service life of even such plated moulds is relatively short, which means expensive repair work to the mould walls.

SUMMARY OF THE INVENTION

It is the aim of the present invention to provide a method of the kind specified which allows a substantial improvement to be obtained in the service life of chill moulds. According to the present invention this aim is achieved due to the fact that a metal layer of nickel is caused to be deposited on the mould wall from a temperature-controlled solution contained in a bath having one or more nickel salts together with hard material particles suspended therein. The mould wall is arranged in an upright position and maintained at a temperature which differs from that of the solution in such a way that the deviation is comprised within the critical deposition temperature range of the bath, the temperature of the mould wall being in the vicinity of one of the limit temperatures and the temperature of the solution in the vicinity of the other limit temperature of said critical temperature range for the bath.

Thus, according to this invention, the interior mould walls are coated with a compound material consisting of nickel and non-metallic hard material particles, which has substantially improved wear-resistance. By comparison with conventional metal plating, chill moulds which have been plated in accordance with this invention can be used satisfactorily for more than twice as long. This is a surprising result, considering the nature of the stresses to which such moulds are exposed. It is true that nickel coatings applied in conjunction with particles of a hard material, such as silicon carbide, in particular for improved wear resistance are known as such. However, in all previously known applications, as for example in motor vehicle cylinder production, there have been fundamentally different conditions compared with those involved in the present invention inasmuch as in these known applications, the special corrosion problems arising from the presence of molten metals or molten slag, as encountered in continuous casting operations, do not occur. For example, with particular regard to silicon carbide, which is also used in accordance with the present invention, there is a considerable risk of attack by the molten steel since silicon and carbon are both soluble in molten steel. The surprisingly good result obtained by the present invention must be primarily ascribed to the thermal behaviour of the wear-protection layer which in turn is due to its association with the basic mould material, i.e. copper or a copper alloy. This thermal behavior causes a sudden, sharp, outwardly directed drop in the temperature gradient of the steel melt which opposes the highly corrosive action of molten steel, molten slag or a liquid lube. However, even after this opposing effect has been surmounted, that is to say, when the peripheral zone of the casting has solidified, extremely severe wear conditions continue to persist because the shell of the casting, or its surface, cannot be formed under the same kind of conditions which may be readily adopted to reduce frictional wear for relatively sliding machine parts.

The wear-resistant coating of nickel and particles of a hard material, in particular silicon carbide, may be cathodically deposited, that is to say by application of an electric current, or without current application. Whereas cathodic deposition presents no major problems, it is important to remember that a currentless plating process is based on reduction which cannot initially occur on copper surfaces. The copper surface, therefore, requires initial activation which is applied either cathodically for a brief period at the beginning of the plating process or by bringing it into contact with iron. For the latter process, the present invention provides for the interior mould wall surface to be subjected to the action of a jet of spherical iron balls or shot, but at such low kinetic energy as to avoid deformation or undesirable modification of strength and hardness in the copper layer. If the mould wall is sloped at a suitable angle the shot particles, particularly if small, can be advantageously applied as a free-falling shower. The shot employed in such a shower may then be caught at the bottom of the vessel and repeatedly recirculated until an initial nickel layer has been formed, whereafter, further plating proceeds without problems.

DESCRIPTION OF THE PREFERRED EMBODIMENTS

Regarding the practical application of the process under consideration, the achievement of a deposit a highly accurate layer thickness which remains constant over the whole surface area of the inner mould wall merits special attention. In the case of electrolyte deposition, this means avoiding field augmentation in the edge regions of the mould wall and, to this end, spacing the anodes at suitable distances or even providing gaps. However, electrolytically deposited coatings will normally require no more than a final polishing operation to achieve an exactly plane and dimensionally true surface.

By contrast, currentless deposition coatings have the advantage of being formed to a dimensional tolerance of ±2 to 5% directly. This means that a finishing treatment can be dispensed with so that the currentless deposition method, which due to its inherent slower deposition rate is basically more expensive actually becomes more economical as a result of the omission of final polishing or similar treatment.

The improved wear resistance in electrolytically deposited, as well as in currentless deposition layers results from the embedded particles of hard material being evenly distributed in the nickel. This not only requires the presence of a circulation or revolving flow movement in order to maintain the particles of hard material in a state of suspension, as is commonly known, but it is also vitally important to maintain a constant concentration of hard material particles in the solution over the whole area of the mould wall, which latter is arranged in an upright position inside a treatment vessel. This is achieved by creating a turbulent flow condition in the solution which, according to the present invention, is intensified further as a result of the upright mould wall being maintained at a temperature different from that of the solution. By these provisions an additional flow condition or current is generated between the solution and mould wall due to the temperature gradient which is quite considerable, especially with surfaces having a major extension in the vertical direction as is the case with the chill mould walls used for continuous slab casting.

In the case of electrolytic deposition, the intensified flow conditions may be combined with an increased current intensity.

For example, for electrolytic deposition a solution is suitable which has the following composition and is applied under the following operative conditions:

| | |
|---|---|
| nickel sulphate ($NiSO_4.7H_2O$) | 250 g/l |
| nickel chloride ($NiCl_2.6H_2O$) | 50 g/l |
| boric acid ($H_3BO_3$) | 30 g/l |
| silicon carbide (SiC grain size < 44 μm) | 100 g/l |
| current density | 3 A/dm$^2$ |
| temperature | 30° to 70° C. |
| pH-index | 3.5 |

With a similar solution it is also possible to obtain dispersion-hardened coatings, so called, by replacing the silicon carbide in the foregoing table with aluminum oxide $Al_2O_3$, which, in the form of polishing alumina has a grain size of about 0.3 μm and which may be present in the solution in the same or lower concentration.

In another embodiment of the invention, a solution of the aforedescribed kind may also be applied in which about half the quantity of hard material particles consists of aluminum oxide with the above mentioned grain size and the other half of silicon carbide of the above specified grain size, the total and combined quantity of solid particles being likewise present in a concentration of 100 g/l.

For currentless nickel deposition, the composition of the solution requires some modification because, for a reduction of the salt concentration to, in all, about 1/10 of that for electrolytical deposition, a reduction partner must be introduced for the nickel salt. Sodium hyphosphite $NaH_3PO_2$, is a known reduction partner of this type. Accordingly, currentless deposition may be obtained by application of a solution of the kind specified below and under the following operative conditions:

| | |
|---|---|
| nickel sulphate ($NiSO_4.H_2O$) | 30 g/l |

-continued

| | |
|---|---|
| sodium hypophosphite ($NaH_3PO_2.H_2O$) | 10 g/l |
| sodium acetate $CH_3COONa.3(H_2O)$ | 10 g/l |
| temperature | 75° to 95° C. |
| pH index | 4 to 6 |
| silicon carbide (SiC grain size < 44 μm) | 100 g/l |

Such layers produced by currentless deposition, in addition to the wear resistance arising from the hard material particles incorporated therein, have the further advantage that they can be hardened by heat treatment at temperatures above 350° C. or thereabouts and preferably below 600° C., which increases their hardness Hv from about 500 to about 1000. This is due to the phosphorous which is absorbed with the deposition process and which enables subsequent precipitation of $Ni_3P$.

In continuous casting practice this advantage can be very easily put to use by operating the moulds during the first charges after their installation in the upper temperature range. In that case a particularly strongly defined matrix hardness will be superimposed on the wear-resistance arising from the presence of the hard material particles.

The solution for electrolytic deposition as well as the solution for currentless deposition, both permit application in a temperature range which, according to one aspect of this invention, is utilized for producing an additional current flow between solution on the one hand and mould wall on the other. In order to render this flow as intensive as possible, the critical deposition temperature range for the solution should include within its two defined limit temperatures the temperature of the mould wall and also the temperature of the solution, the two temperatures being in the vicinity of the said limits. Depending on whether the temperature of the mould wall is higher or lower than that of the solution, an upwardly or downwardly directed current flow will be generated. It is recommended to coordinate the two temperature values in such a way that an up- or down-current is created along the interior mould wall in opposite direction to the circulation current thereby providing maximum turbulence in the vicinity of the deposition regions. Apart from this, the circulation flow rate in the solutions is adjusted to be at all times higher than the sedimentation or sinking speed of the hard material particles suspended therein. Conveniently the sinking speed of the hard material particles is ascertained prior to the operation by observing sedimentation of such particles in a glass cylinder or the like. It depends essentially on the density and on the size of the particles as well as on the viscosity of the solution.

The turbulence caused by the rising and falling currents along the inner mould wall may be further increased by arranging for the latter to diverge from the vertical with an increase in the flow section of the circulating current. This will lead to local eddy-formation along the interior mould wall surface and contribute further to the creation of flow turbulence.

I claim:

1. A method of depositing a metal coating on a wall of a chill mould for continuous casting, comprising the steps of: arranging said wall in approximately an upright position in a bath containing a solution of at least one nickel salt and particles of a hard material suspended in said solution, determining the critical deposition temperature range of said bath defined by an upper temperature limit and a lower temperature limit, and depositing a metallic layer containing nickel on said wall while maintaining said wall at a temperature in the vicinity of one of said upper and lower temperature limits and maintaining said solution at a temperature in the vicinity of the other of said upper and lower temperature limits, the temperature difference between said wall and said solution being within said critical deposition temperature range.

2. A method according to claim 1, wherein during the deposition process the solution is maintained in a state of turbulent flow throughout its cross section.

3. A method according to claim 1, wherein said wall is made of copper and including the additional step of applying a stream of globular iron shot at the start of the deposition process to said wall.

4. A method according to claim 3, wherein the iron shot is applied as a free-falling shower to said walls and is recirculated.

5. The method according to claim 1, and further comprising determining the sedimentation speed of said particles in said solution, and during said deposition, circulating said solution at a speed which is higher than said sedimentation speed.

6. A method according to claim 1, and further comprising determining the rising and falling currents of said solution along said wall, and during said deposition, circulating said solution in a direction opposite to the direction of said currents.

7. The method according to claim 1, and further comprising positioning the wall so that its slope diverges from said approximately upright position to form a slope with respect to the vertical direction to produce an increase in the flow section of the currents in said solution.

* * * * *